United States Patent [19]

Cannan

[11] Patent Number: 4,856,782

[45] Date of Patent: Aug. 15, 1989

[54] RELEASE-JOINTED GOLF CLUB

[76] Inventor: William D. Cannan, 105 Mendota Dr., Greece, N.Y. 14626

[21] Appl. No.: 210,351

[22] Filed: Jun. 23, 1988

[51] Int. Cl.[4] ..... A63B 69/36; A63B 53/12; A63B 53/08

[52] U.S. Cl. ..... 273/80 B; 273/193 B; 273/186 A; 273/81.3; 273/80.1

[58] Field of Search ..... 273/193 B, 186 A, 80 B, 273/81.2, 81.3, 81 R, 81 C, 80 C, 80 D, 80.1

[56] References Cited

U.S. PATENT DOCUMENTS 2,158,211 5/1939 Aitken ..... 273/193 B 2,159,579 5/1939 Whitney ..... 273/193 B

*Primary Examiner*—George J. Marlo

*Attorney, Agent, or Firm*—Robert J. Bird

[57] ABSTRACT

A golf club shaft includes an articulated release joint connecting the lower and upper sections of the shaft in alignment. The release joint includes a lower link fixed to the lower section of the shaft and an upper link fixed to the upper section of the shaft. The links are pivotally connected for relative rotation in response to impact on the shaft to permit the lower section to rotate relative to the upper section to relieve the stress of impact. The pivot is on a threaded hinge pin which is adjustable to vary the friction within the release joint and thereby the responsiveness of the joint to impact on the shaft.

2 Claims, 1 Drawing Sheet

RELEASE-JOINTED GOLF CLUB

BACKGROUND OF THE INVENTION

1. Field of the Invention

The subject matter of this invention is a golf club, and relates more particularly to a golf club having a release-jointed shaft for preferential release upon impact with the ground.

2. Background Information

The shaft of a golf club is essentially rigid. Although it has some inherent resilience, and may even have some resilience added by design for greater ball impact, it is still essentially rigid and not flexible. In a good shot, the club head makes solid contact with the ball and only incidental contact with the ground, and the swing and follow through are complete. Sometimes there is more contact with the ground and a divot is taken, but the swing and follow through are completed nevertheless. A poor swing may make little or no contact with the ball, and such abrupt contact with the ground that the golfer experiences pain, particularly back, shoulder, or elbow pain. These are real injuries. The accomplished golfer is less likely to suffer an injury of this sort, and the frequent golfer may have such golf-related muscle tone as to be relatively immune to it. For the occasional or recreational golfer, however, the likelihood of such injury is more significant and it is desirable to reduce or eliminate it. Such is the object of this invention.

SUMMARY OF THE INVENTION

In summary, the present invention is a golf club shaft including an articulated release joint connecting the lower and upper sections of the shaft in alignment. The release joint includes a lower link fixed to the lower section of the shaft and an upper link fixed to the upper section of the shaft. The links are pivotally connected for relative rotation in response to impact on the shaft to permit the lower section to rotate relative to the upper section to relieve the stress of impact. The pivot is on a threaded hinge pin which is adjustable to vary the friction within the release joint and thereby the responsiveness of the joint to impact on the shaft.

DRAWING

DESCRIPTION OF THE PREFERRED EMBODIMENT

Figure 1:
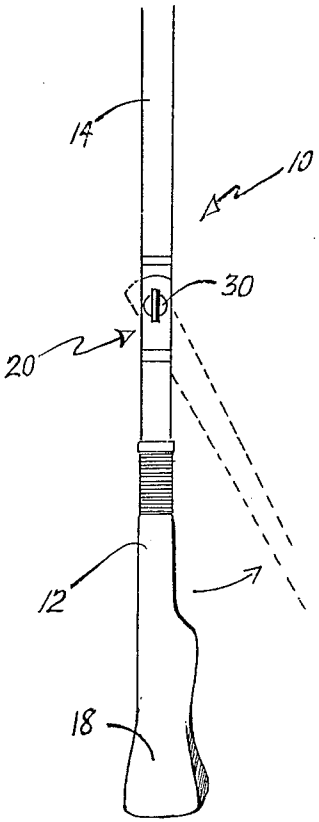
FIG. 1 shows the head end of a golf club, viewed as from behind the golfer, and including the joint of this invention.

Referring to FIG. 1, the golf club of this invention includes a shaft 10 with a club head 18 mounted on the end of the shaft. The shaft 10 includes a lower section 12 connected to the club head, an upper section 14 leading to the club handle (not shown), and an articulated joint 20 connecting the lower and upper sections.

Figure 3:
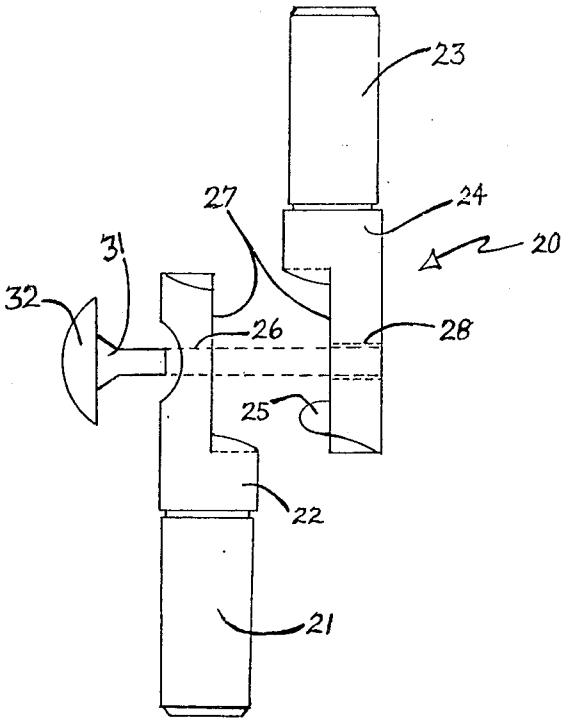
FIG. 3 is an exploded view of the release joint viewed as from the right side of FIG. 2.
Figure 2:
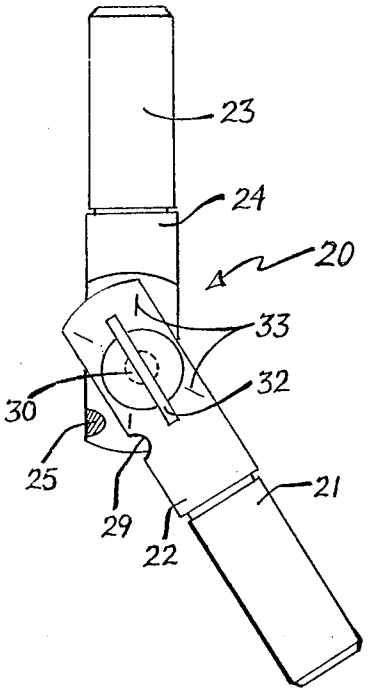
FIG. 2 is an enlarged view of the release joint, viewed in the same direction as in FIG. 1.

Referring now particularly to FIGS. 2 and 3, the articulated joint 20 is a separate and discrete structural component of the shaft, and includes a lower link 22 fixed to the lower section 12 of the shaft, and an upper link 24 fixed to the upper link 14 of the shaft. The links 22 and 24 of the joint are joined at a pivot connection 30. The orientation of the pivot connection 30 is such that its pivotal movement is in the same plane as the swing of the club. The lower link 22 of the joint includes a cylindrical shank 21 which fits tightly within the tubular lower shaft 12. The upper link 24 of the joint includes a similar cylindrical shank 23 which fits tightly within the upper shaft 14.

The lower and upper links 22 and 24 include mutually aligned transverse holes 26 and 28 respectively. Links 22 and 24 are joined at mating planar faces 27. The hole 28 in the upper link 24 is threaded. The hole 26 in the lower link is partially tapered. The upper link 24 includes a protruding stop or abutment 25. The lower link 22 includes an aperture or groove 29 which mates with the abutment 25. The upper and lower links 22 and 24, and the abutment 25, are so configured that when the joint 20 is in its straight locked position, as in FIG. 1, the outer surfaces of the links form a smooth cylinder.

The pivot connection 30 of the joint 20 is formed by a threaded hinge pin or screw 31 which extends freely through the hole 26 of the lower link 22, and is threaded into the hole 28 of the upper link 24. The threaded hinge pin 31 is tapered at its head end to mate with the tapered hole 26 in the lower link 22. The threaded hinge pin 31 pulls the jointed connection together and creates frictional engagement between the links 22 and 24 of the release joint at their interfaces 27, and between the hinge pin itself and the lower link 22 at their mating tapered surfaces. The frictional engagement between hinge pin and lower link, and between the links, is increased or decreased by tightening or loosening the hinge pin 31, to thereby vary the release setting of the joint 20, the level of stress on the joint at which the joint will respond to break the shaft alignment and relieve the stress. The hinge pin 31 includes a gripping head 32 for manual operation. A plurality of indicia 33, marked on the lower link 22 around the hinge screw 31, provide a screw position scale as an indicator of relative settings of the release joint.

In using this invention, should golfer's swing make abrupt contact with the ground or some other obstacle, the load-responsive release joint 20 in the club handle will give way, as illustrated by phantom lines in FIG. 1, so that the golfers body, back, shoulders, or elbows are not shock loaded by the instant stop of the club head. Although the club head 18 may stop abruptly, the upper club handle does not. It is permitted a follow through to prevent injury to the golfer.

The foregoing description of this invention is intended as illustrative. The concept and scope of the invention are limited only by the following claims and equivalents thereof.

What is claimed is:

1. A golf club including a shaft (10) having a lower section (12) and an upper section (14) connected to each other in alignment by an articulated release joint (20), said joint being responsive to impact on said shaft to permit said lower section to rotate relative to said upper section in the plane of swing of said club, said release joint including a threaded hinge pin (31) extending through one of said sections and threaded into the other of said sections to pull said sections together in frictional engagement with each other and with said hinge pin, and adjustment means (32) to vary the responsiveness of said release joint to said impact, said adjustment means including indicia (33) of the setting thereof.

2. A golf club including a shaft (10) having a lower section (12), an upper section (14), and an articulated release joint (20) connecting said lower and upper sections, said release joint including a lower link (22) fixed to said lower section of said shaft and an upper link (24) fixed to said upper section of said shaft said links being pivotally connected for relative rotation on the axis of a pivot (30) said joint being responsive to impact on said shaft to permit said lower section to rotate relative to said upper section in the plane of swing of said club, said release joint including a threaded hinge pin (31) forming said pivot and extending through one of said sections and threaded into the other of said sections to pull said sections together in frictional engagement with each other and with said hinge pin, and adjustment means (32) to vary the responsiveness of said release joint to said impact, said adjustment means including indicia (33) of the setting thereof.

* * * * *